United States Patent [19]

Moena

[11] 4,119,314

[45] Oct. 10, 1978

[54] MINIATURE SOCCER-FOOTBALL GAME TOY

[76] Inventor: Nibaldo Mosciatti Moena, Cochrane 450, Concepcion, Chile

[21] Appl. No.: 762,124

[22] Filed: Jan. 24, 1977

[51] Int. Cl.[2] ..... A63F 7/06

[52] U.S. Cl. ..... 273/85 F; 273/129 GA

[58] Field of Search ..... 273/85 F, 129 GA; 46/268

[56] References Cited

U.S. PATENT DOCUMENTS

| | | | |
|---|---|---|---|
| 3,806,119 | 4/1974 | Masciatti | 273/85 F |
| 3,920,243 | 11/1975 | Santos | 273/85 F |

FOREIGN PATENT DOCUMENTS

| | | | |
|---|---|---|---|
| 1,544,129 | 9/1968 | France | 273/85 F |

*Primary Examiner*—Anton O. Oechsle

*Attorney, Agent, or Firm*—Haseltine, Lake & Waters

[57] ABSTRACT

An improvement in miniature toy football games in which figures representing players and goal-keepers move alternately along paths or trails provided on the surface of a plate which represents the playing field. The players and goal-keepers can be moved, as desired, by an operator pressing corresponding control keys arranged on a control panel. The surface of the playing field has an arrangement of undulations and cavities for guiding the ball towards the foot of a player. The players and goal-keepers are mounted on electromagnetic actuators in the form of a hollow magnet coil horizontally mounted on a frame. The coil has a sliding core linked to a lever arm for producing alternate movement of the players. The actuator is mounted under a slot guiding the movement of the players.

2 Claims, 10 Drawing Figures

FIG. 5
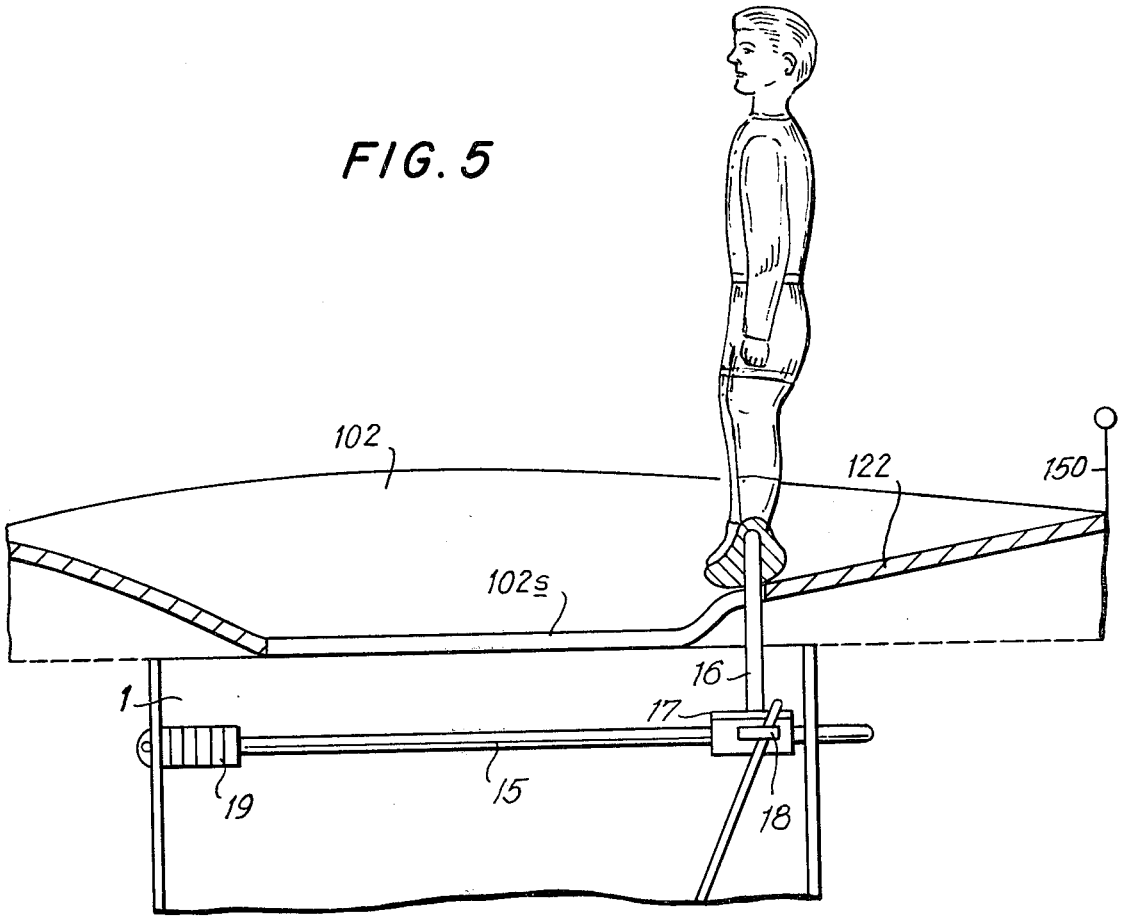
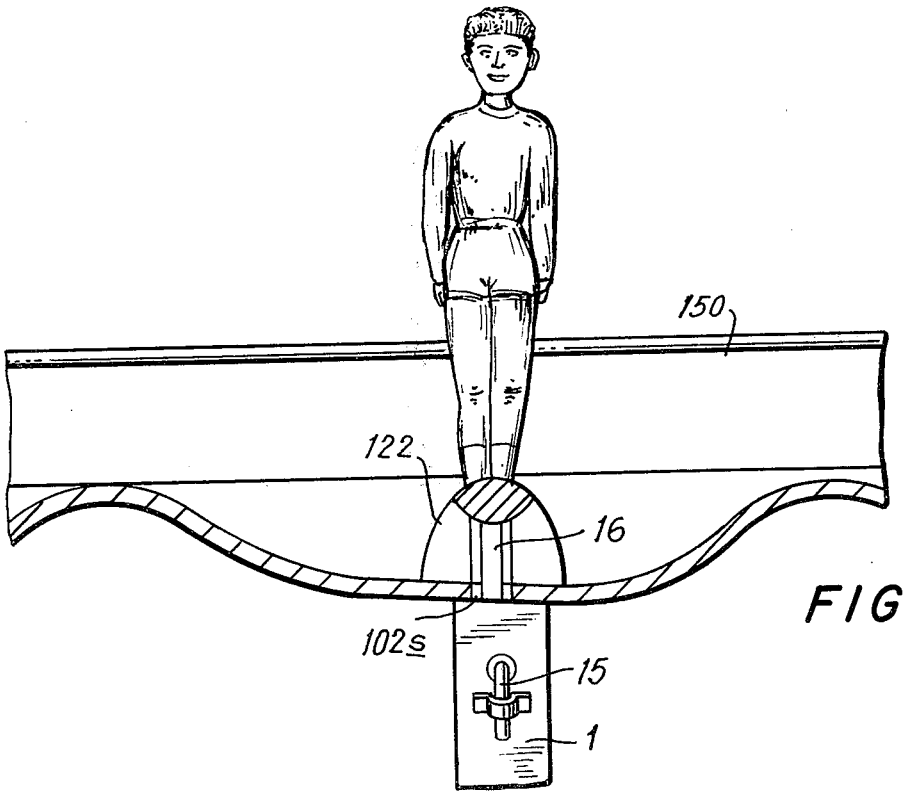
FIG. 6

MINIATURE SOCCER-FOOTBALL GAME TOY

BACKGROUND OF THE INVENTION

The present invention relates to an improvement of the miniature football game toy disclosed in the Chilean Pat. No. 26.924 and the Argentinian Pat. No. 190750. In the improved toy of this invention, the "players" are selectively activated at will by the operators participating in the game. The "players" are activated through the touching of a respective key or button located on a control panel. The operators do not waste any physical effort moving the players and are thus able to concentrate their mental ability and ingenuity on producing a fast and lively game whose object is to score points by sending the ball into the opponent's goal area.

Nowadays, a football game toy is well-known wherein two or more operators can play a miniature football game, the simulated game field being a table or board whereon a number of rotatory and transversally slidable rods are mounted perpendicular to the major axis of the "field". Each of these rods is provided with a predetermined number of wooden, metal or plastic figures representing the "players" in the game, these figures being fixed to the respective rod.

Each operator actuates the respective "players" by rotating and/or sliding the cooperating rod, the rotation and/or transverse movement of the "players" sending the ball in the general direction of the opposed or remote goal area in order to score one point.

As the players are fixed to the rotatory rods, the figures forming "play lines" (forward, center and defense), the movement of the rods produces the movement of the complete "line", thus reducing the originality and liveliness of the game. There also exist "football game" toys wherein the "players" are not manually actuated by the operators but the activation of the "players" is produced through the energization of some type of electromagnetic device, said device producing the movement of the "players" to strike the ball.

The above mentioned "football games" do not permit a real competition between two operators but are almost random games due to the fact that the operators have no means of influencing the actuation of the "players" because the activation of the electromagnetic device associated to each "player" is determined by the opening or closing of a set of electronic contacts caused by random positioning of the metal ball on a recess located at the foot of the "player".

In a similar known "football games", the ball is guided from one "player" to another by a suitable channel or guiding slot, and the operators have no means of influencing the movement of the ball.

SUMMARY OF THE INVENTION

The object of the present invention is to provide a novel and improved miniature football game wherein the operation of the "players" is simplified thus saving physical effort on the part of the operators and only requiring the touching of any one of a number of "keys" or switches suitably arranged on control boards or panels located around the edge or border of the table or "field". The control boards are preferably located behind the "goal area" and near the corners of the table.

The keys are so arranged that they can be easily touched and pressed with the finger-tips or with the back of the palms.

When pressing one or more control keys, the respective operator is able to move one or more "players", even if they are not in contact with the ball, since the "players" are suitably arranged on the "field" surface and can be moved alternately forward or backward along a predetermined path which is defined by slots formed in the "field" surface. The "player" activated by the operator can hit the ball sending said ball to another "player" of the same team; the "player" can send the ball directly into the opposing "goal area", or can even intercept the ball which has been played by an opposing "player". Thus the result of the "game" depends only on the mental ingenuity of the two opposing operators.

The surface of the "field" is a lightgauge metal sheet, or a reinforced plastic plate comprising a number of suitably arranged undulations defining guides, slots, or channels to allow the ball to move in the general direction of the "player" opposite to the one hitting the ball. Around the outer edge of the "field" a "fence" (made of plastic material) of a suitable height is provided to prevent the ball from falling out of the "field" in the event of an "off-side".

A novel arrangement is provided for the activation of the "players" comprising an electromagnetic coil with a movable magnetic core linked to a lever arm actuating a sliding arm whereon a respective "player" is mounted, these elements constituting an "actuator".

BRIEF DESCRIPTION OF THE DRAWINGS

The present invention will be described with reference to the accompanying drawings where:

FIG. 5 illustrates a vertical section taken along line A—A of FIG. 4.

FIG. 6 illustrates a vertical section taken along line B—B of FIG. 4.

DESCRIPTION OF THE PREFERRED EMBODIMENTS

Figure 1:
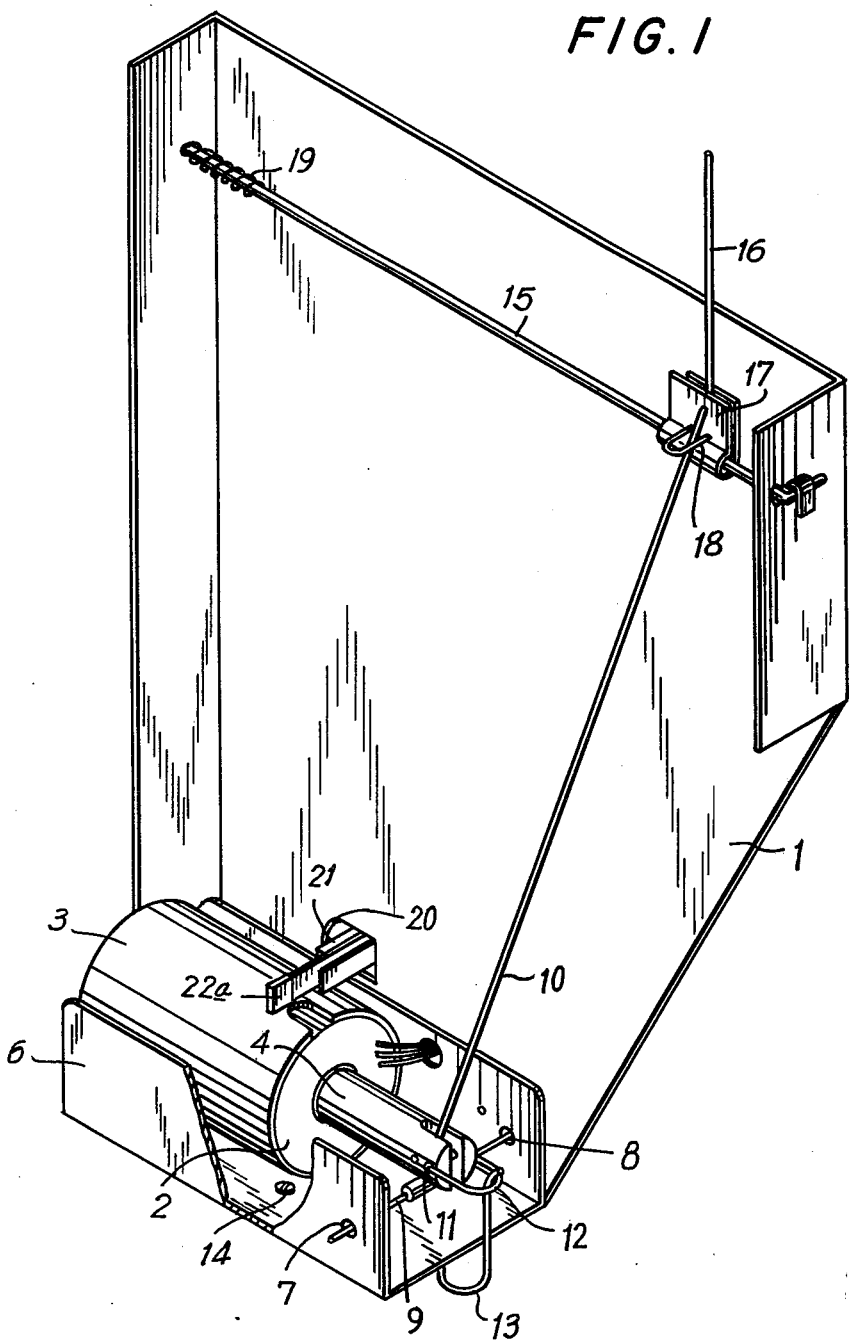
FIG. 1 illustrates a perspective view of a first embodiment of the "actuator" used to activate the "player".
Figure 1A:
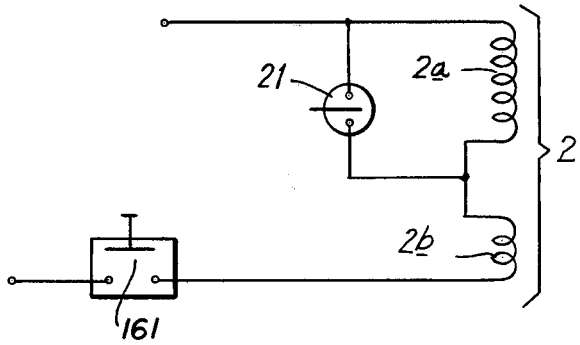
FIG. 1A illustrates the electrical connection of the magnetic coil used in the embodiment of FIG. 1.

FIG. 1 shows a first embodiment of electromagnetical actuator used for activation of the "players" in the football game of the invention. The actuator comprises a frame 1 made of metal sheet or similar material having a hollow core magnetic coil 2 horizontally mounted on the bottom part thereof and inserted into a metal housing 3. This magnetic coil 2 is provided with a metal core 4 slidable mounted in the hollow core of the coil and having a recess 5 formed in the outer end thereof.

The metal housing 3 is mounted in a bracket 6 affixed to the bottom part of said frame 1.

In the lower front portion of bracket 6 the are located two coaxial small diameter holes 7, 8, wherein is inserted a shaft 9.

A long lever arm 10 is suitably fixed to the shaft 9, passing through the recess 5 of the core 4 between the bottom end of said recess and pin 11 located transversely to the core 4 at the open end of the recess 5.

Figure 2:
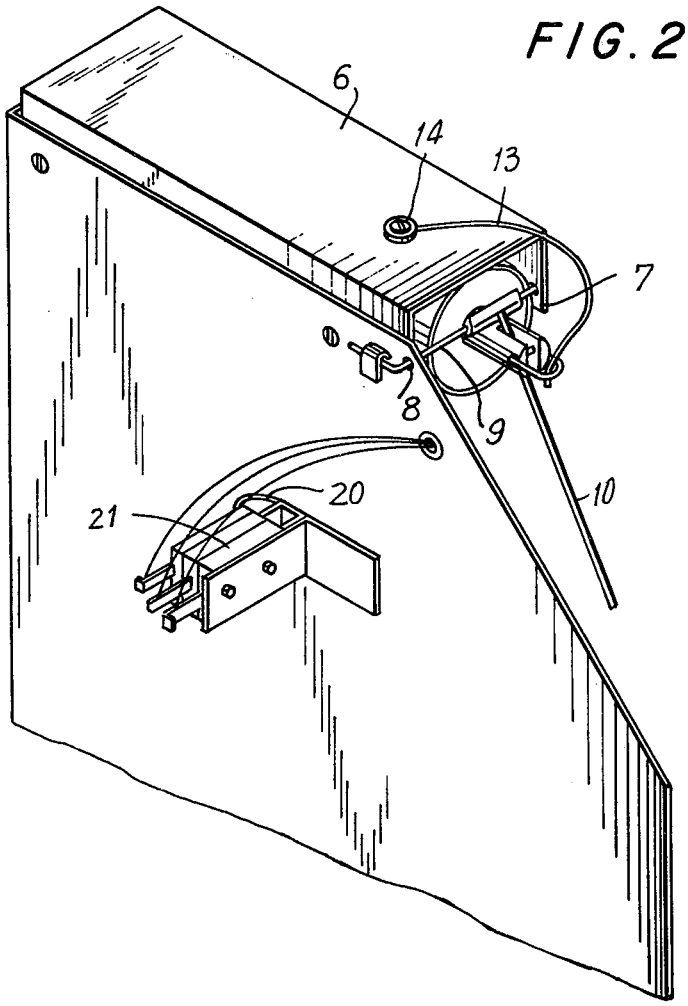
FIG. 2 is a part bottom view of the "actuator" of FIG. 1.

A biassing spring 13 affixed by rivet or a bolt 14 to the under part of the bracket 6 (FIG. 2) is engaged in a half-ring 12 fixed to the transverse pin 11, thus normally holding the core 4 in a position remote from the coil 2. The biassing force of the spring 13 is not strong enough to prevent the core 4 from being moved into the hollow core coil 3 when said coil is energized, but only to return said core 4 to its outward position when coil 2 is de-energized, thus maintaining the lever-arm 10 in its right hand position, as shown in FIG. 1.

In the upper part of frame 1 there is provided a guide rail 15 fixed to said frame 1, a vertical pin 16 being slidably mounted on said rail 15 by means of a sliding support 17 having an eyelet 18 wherein the outer end of the lever arm 10 is engaged. In the left portion of the guide rail 15 there exists a spring 19 to provide a cushioning means for the support 17 and cooperating pin 16 in its movement to the left of the frame 1.

The magnetic coil 2 comprises a high current coil **2*a* and a low current coil 2*b* connected in series, the high current coil being shunted by the spring switch 21** when the actuator is de-energized.

When the key switch 161 is pressed, the high current coil **2*a* is energized and the movable core 4 moves into the hollow coil, moving the pivoting arm lever 10 towards the left-hand side of the actuator (FIG. 1) thus sliding the support plate 17 and attached pin 16 towards the cushioning spring 19**.

Suitably located, through a window 20, is a normally closed switch 21, shunting the magnetic coil **2*a*. When the lever arm 10 reaches its leftward position and the support plate 17 abuts the spring 19, said lever arm 10 pushes the contact 22 opening the electrical shunt coil 2 thus allowing both coils 2*a* and 2*b* to remain energized while the switch 161** is kept depressed, without overheating of the coils.

When the coil 2 is de-energized, the biassing spring 13 forces the core 4 out of the hollow coil, thus moving the lever arm 10 to its original position, together with the sliding plate 17 and pin 16. As soon as the coil is de-energized and the spring 13 outwardly moves the core 4, the spring contact 22 closes, thus allowing the high current coil **2*a*** to be again energized by the operator's pressing of the respective control key located on the control panel.

Figure 3:
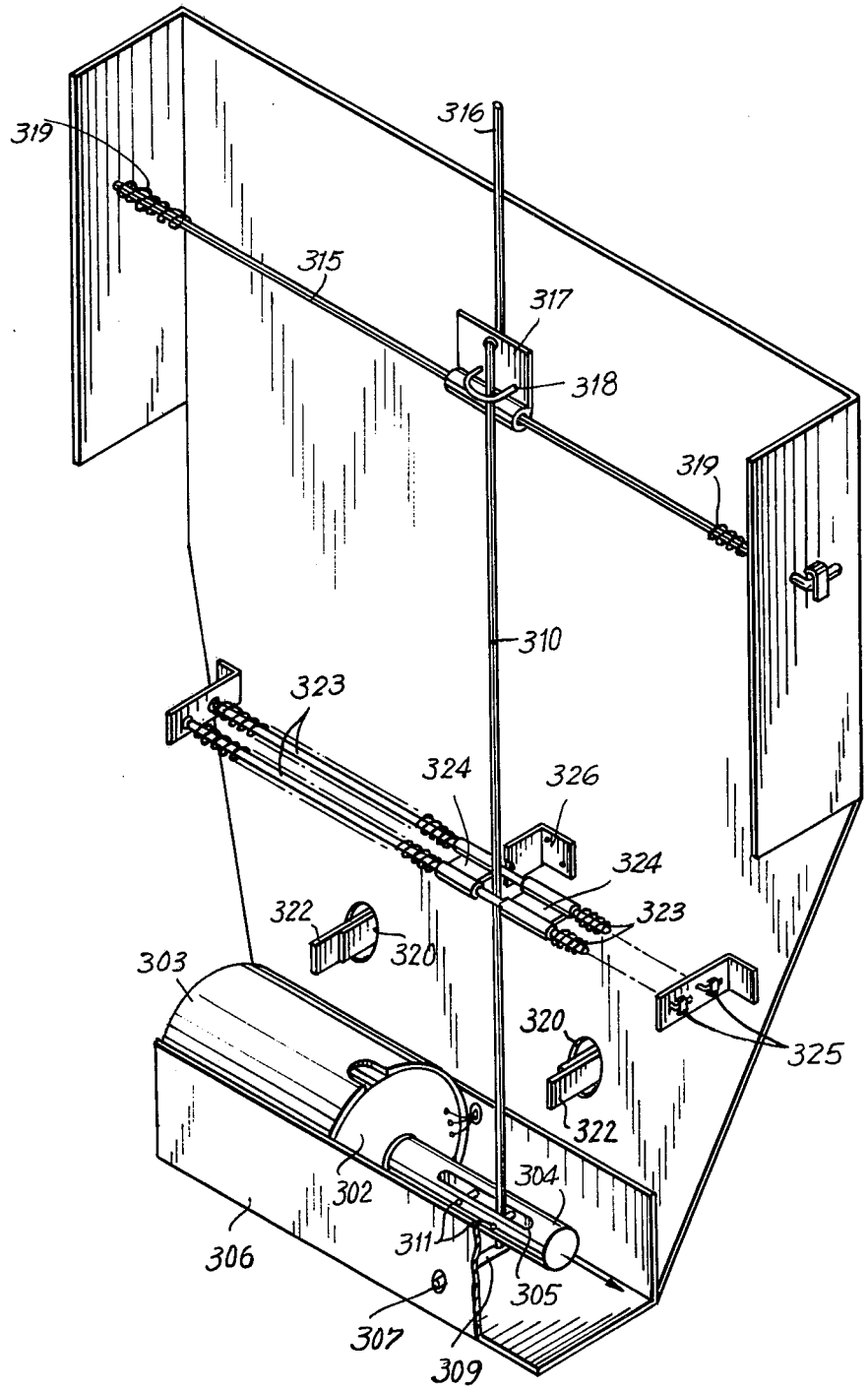
FIG. 3 illustrates a perspective view of a second embodiment of the actuator.
Figure 3A:
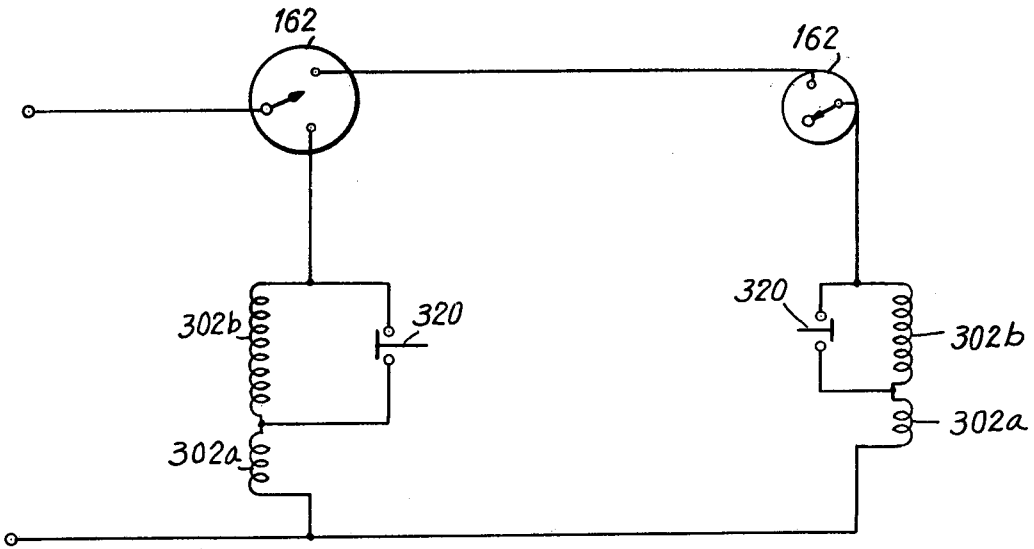
FIG. 3A illustrates the electrical connection of the magnetic coil used in the embodiment of FIG. 3.

FIG. 3 illustrates a double actuator, similar to the one already described, preferably used to activate the "goal-keeper" of the football game of the invention.

The double-actuator comprises two opposed magnetic hollow coils 302, coaxially arranged, (only one of which is shown for simplicity of the drawing), having a common magnetic core (304). Both coils are similar to the coil used in the embodiment already described, and to prevent any possibility of damage if both keys 162 are pressed simultaneously, said key switches are electrically interlocked allowing only one of the coils to be energized.

Said core (304) presents an elongated recess or slot (305) centrally located, and provided with two transverse pins 311 suitably separated one from the other.

A lever arm 310, affixed to a shaft 309 pivoting in the small diameter holes 307, 308 projects through the opening between the pins 311.

The outer end of lever arm 310 engages the eyelet 318 of sliding support 317 wherein the vertical pin 316 is affixed.

Said support 317 is slidably mounted on the guide rail 315 having springs 319 at both ends thereon for cushioning the movement of the sliding support 317.

Two guide rails 325 are located at a suitable height of frame 301, the lever arm 310 passing through between said rails 325.

Sliding stops 324 are pressed by springs 323 against the lever arm 310, said sliding stops 324 abutting the fixed stop 325, thus maintaining the lever arm 310 in a center location when both coils 302 are de-energized.

When one of the coils 302 is energized, the core 304 moves into the coil forcing the lever arm 310 to move in the same direction as the energized coil. The lever arm 310 presses against the sliding stop 324 and respective springs 323 until the level arm 310 opens the spring contact 322 of the switch 320 (not shown) thus deenergizing the coil 302, the springs 323 and cooperating sliding stop 324 forcing the lever arm 310 to its original center position, the fixed stop 326 preventing overtravel of the lever arm 310 from the center position until any of the coils 302 is again energized by the operator.

Figure 4:
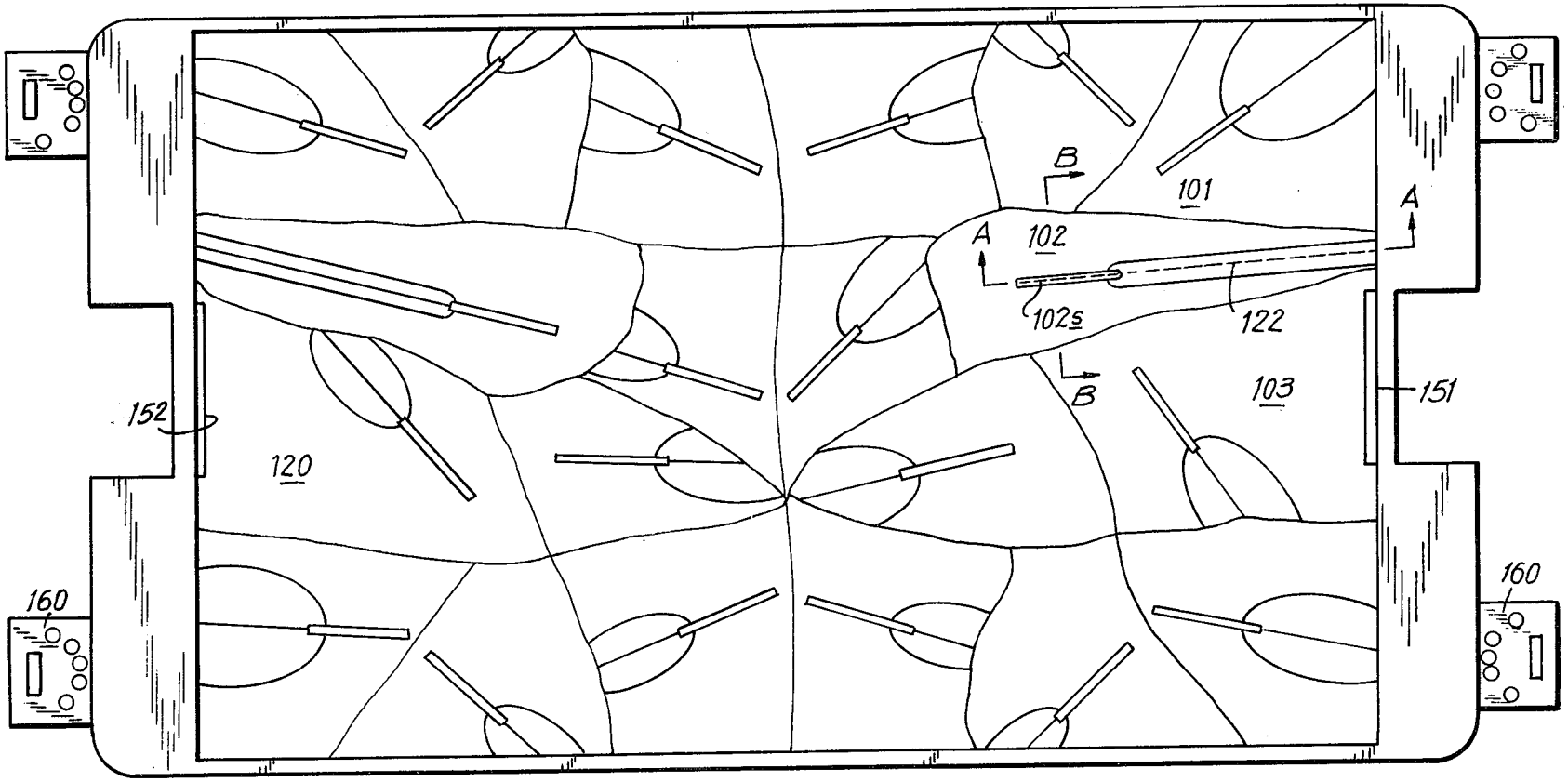
FIG. 4 is a plan view of the "field", illustrating the arrangement of the "guide slots" on the field surface.

FIG. 4 illustrates a top plan view of the "field" for the "football game" of this invention, made of light sheet metal or reinforced plastic material. The surface of the "field" is divided into a number of "player's areas" 101, 102 . . . 119, 120.

Suitably located in each of these areas is formed an elongated narrow slot **101*s*, 102*s*, . . . 119*s*, 120*s* defining the direction of the alternative movement of the player mounted and affixed to the vertical pin 5 of the respective electromagnetic actuator located beneath the surace of the "field", (FIGS. 5 and 6**).

Each "player's area" is defined by undulations, the slopes thereon being in the general direction of the respective slot existing in the "player's area" to direct the ball to the vertical pin 5 projecting through the slot.

FIGS. 5 and 6 illustrate a section taken along lines A—A and B—B of the player area 102 of FIG. 4, with this area being representative of any one of the player's areas of the "field".

Behind each slot **102*s* there exists a substantially rectilinear small mound 122** to prevent the ball from being detained behind the "player", and forcing the ball to the front of the player.

Along the entire perimeter of the "field" there extends a resilient fence 150 to prevent the ball from leaving the field.

In front of each "goal-area" there is located a respective slot 151, 152 whereat the "goal-keeper" associated to the electromagnetic actuator described in relation to FIG. 3 can be moved transversally to the goal-area to cover the "door" and prevent the scoring of a point by the opposing team.

Figure 7:
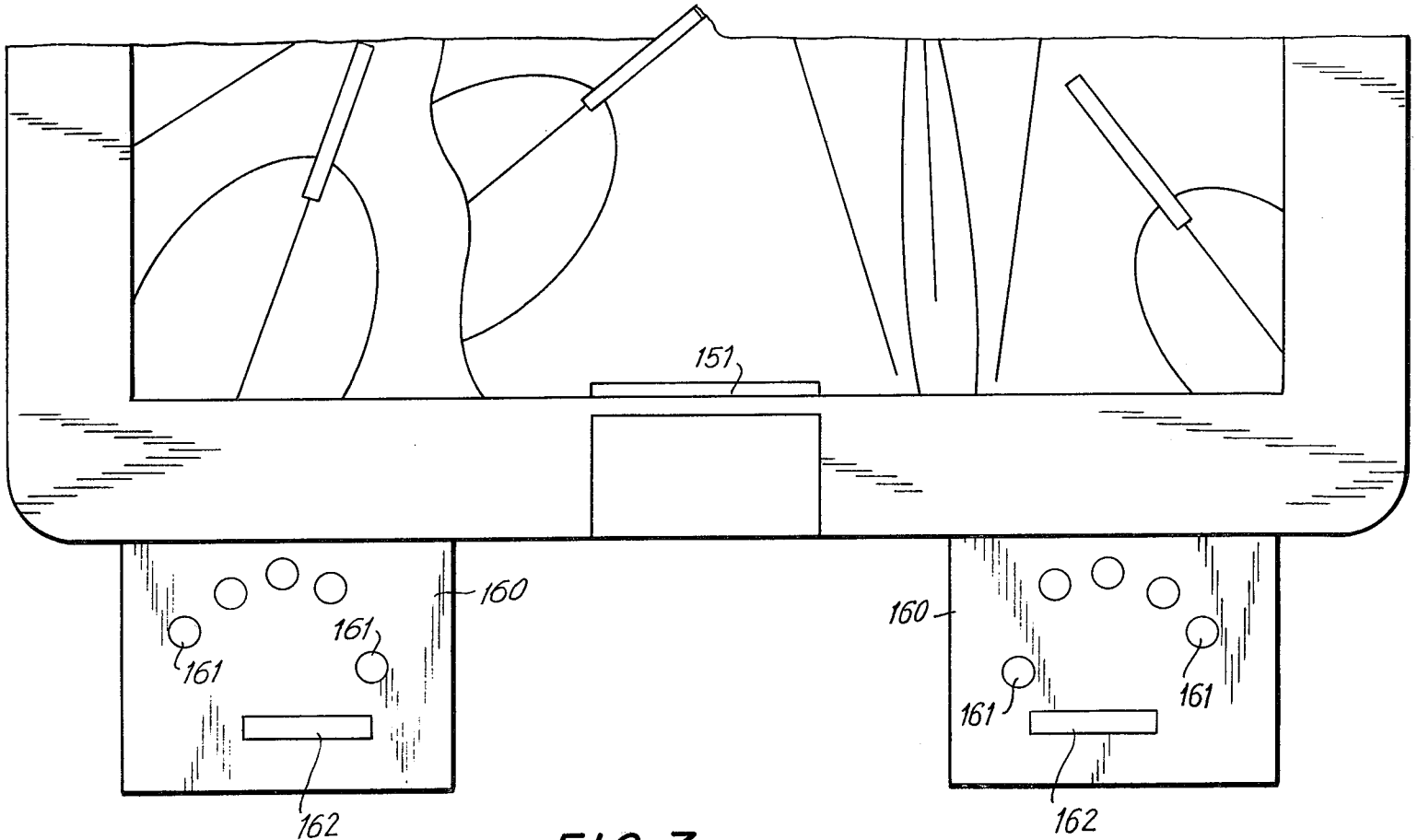
FIG. 7 illustrates the location of the control panels for activating the "players" of one team.
Figure 8:
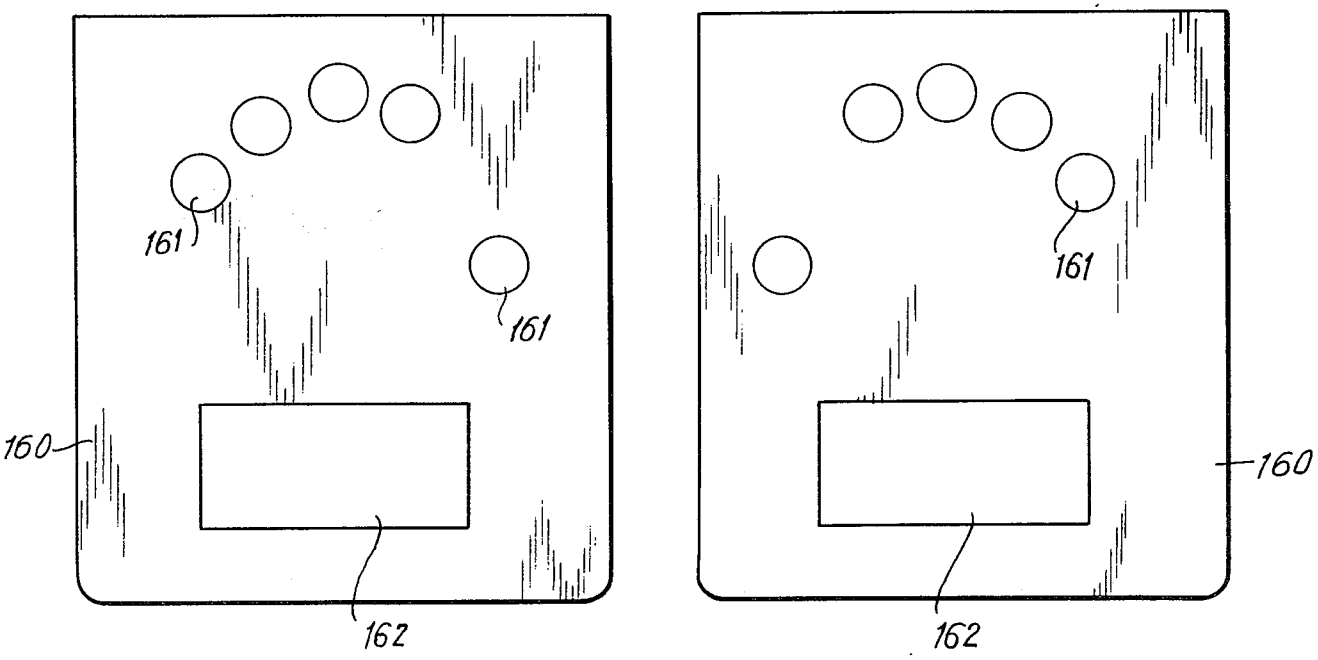
FIG. 8 illustrates a preferred arrangement of the control keys on the control panels.

Behind each of the short sides of the field, and near the corners of said field, there are located two control panels 160 (FIGS. 4 and 7) each panel comprising five small keys 161 arranged in a position comfortable for finger-tip operation, and a larger key 162 located close to the rear edge of the panel 160.

The small keys 161 energize the respective single-coil actuators associated to the "players" (FIG. 1) and each of the larger keys 162 energizes the respective left and right-hand coils of the double-coil actuator described in reference to FIG. 3.

The interconnection of the electromagnetic actuators activating the respective players to the keys on the control boards can be arranged, for instance, for the keys located on the left control board to activate the players of the left-hand side of the field, and vice-versa, or any other suitable combination.

The novelty of the "field" of the invention is in the arrangement of the elongated slots guiding the alternative movement of the players, said arrangement being such that each player is always in a convenient position for receiving, hitting and directing the ball to another player of the same team, or even intercepting the ball sent by a player from the other team, the novelty being also in the shaping and arrangement of the player's areas surrounding each of the respective slots. These areas always direct the ball towards the slot and the front of the respective player.

The frame of the electromagnetic actuator is mounted under the surface of the field, directly under the slot guiding the movement of the respective player, with the forward or energized movement of the player affixed to the vertical pin of the actuator facing the general direction of the opposing team's goal area.

I claim:

1. A miniature football game toy comprising: a ball; a plate carrying the field on which the game is to be played and having paths along which players of the game are movable; said plate having a field surface with undulations and cavities for guiding said ball towards the foot of a player; figures representing players and goal-keepers moving alternately along said paths on the surface of said plate; a control panel with control keys actuatable by an operator for moving said players and goal keepers, electromagnetic actuator means for mounting the players and goal-keepers being defined by a frame, at least one hollow magnetic coil horizontally mounted on said frame, a lever arm, said coil having a sliding core articulately linked to said lever arm for producing alternate movement of the players, said sliding core and said lever arm being mounted in the lower portion of said frame and further defined by a sliding support carrying a vertical pin and being connected to the upper end of said lever arm, a guide rail, said support being movable on said guide rail in a direction substantially parallel to said sliding magnetic core, said vertical pin having a length of movement corresponding substantially to the length of a guiding slot for the respective player and said plate having a slot for guiding the movement of the players, said actuator means being mounted under said slot.

2. A miniature football game toy comprising: a ball; a plate carrying the field on which the game is to be played and having paths along which players of the game are movable; said plate having a field surface with undulations and cavities for guiding said ball towards the foot of a player; figures representing players and goal-keepers moving alternately along said paths on the surface of said plate; a control panel with control keys actuatable by an operator for moving said players and goal-keepers, electromagnetic actuator means for mounting the players and goal-keepers being defined by a frame, at least one hollow magnetic coil horizontally mounted on said frame, a lever arm, said coil having a sliding core articulately linked to said lever arm for producing alternate movement of the players, said sliding core and said lever arm being mounted in the lower portion of said frame and further defined by a sliding support carrying a vertical pin and being connected to the upper end of said lever arm, a guide rail, said support being movable on said guide rail in a direction substantially parallel to said sliding magnetic core, said vertical pin having a length of movement corresponding substantially to the length of a guide slot for the respective player and said plate having a slot for guiding the movement of the players, said actuator means being mounted under said slot and control keys on said control panel to energize said magnetic coil and applying thereby movement to said sliding core, said control keys being connected to said magnetic coil, said control panel being located behind goal areas and substantially in proximity to corners of said field.

* * * * *